US006840247B2

(12) United States Patent
Maiwald et al.

(10) Patent No.: US 6,840,247 B2
(45) Date of Patent: Jan. 11, 2005

(54) FILTER-ATTACHMENT MACHINE AND METHOD OF OPERATING A FILTER-ATTACHMENT MACHINE

(75) Inventors: Berthold Maiwald, Schwarzenbek (DE); Manfred Dombek, Dassendorf (DE); Manfred Folger, Hamburg (DE); Karl-Heinz Pawelko, Marschacht (DE); Franz Rottmann, Glinde (DE)

(73) Assignee: Hauni Maschinenbau AG, Hamburg (DE)

( * ) Notice: Subject to any disclaimer, the term of this patent is extended or adjusted under 35 U.S.C. 154(b) by 71 days.

(21) Appl. No.: 10/315,232

(22) Filed: Dec. 10, 2002

(65) Prior Publication Data

US 2003/0111086 A1 Jun. 19, 2003

(30) Foreign Application Priority Data

Dec. 11, 2001 (DE) ..... 101 60 822

(51) Int. Cl.[7] ..... A24C 5/58

(52) U.S. Cl. ..... 131/94; 131/88; 83/298; 83/284

(58) Field of Search ..... 83/298, 284, 342, 83/345; 131/94, 282, 88

(56) References Cited

U.S. PATENT DOCUMENTS 2,957,450 A 10/1960 Phillips, Jr.
3,874,391 A * 4/1975 Dogl et al. ..... 131/280
4,237,907 A 12/1980 Pawelko et al.
4,255,998 A 3/1981 Rudszinat
4,548,216 A * 10/1985 Ahern ..... 131/94
4,860,623 A 8/1989 Pawelko
4,886,077 A * 12/1989 Hinzmann et al. ..... 131/282
6,229,115 B1 5/2001 Voss et al.

FOREIGN PATENT DOCUMENTS

| | | |
|---|---|---|
| DE | 1 187 171 | 2/1965 |
| DE | 1 242 134 | 6/1967 |
| GB | 981434 | 1/1965 |
| GB | 2 279 226 | 1/1995 |
| WO | 80/00526 A1 | 4/1980 |

* cited by examiner

*Primary Examiner*—Dionne A. Walls
(74) *Attorney, Agent, or Firm*—Venable LLP; Robert Kinberg

(57) ABSTRACT

A filter-attachment machine in the tobacco-processing industry is provided. The machine has a plurality of conveying devices for products in the tobacco-processing industry, and at least one main drive that drives the plurality of conveying devices. The machine also has a pull-off device for pulling a cover tape ribbon from a cover tape supply, a cover-tape cutting device for cutting the cover tape ribbon into sections of a predetermined length, and at least one secondary drive that drives the pull-off device and the cover-tape cutting device. The cover tape ribbon is conveyed from the pull-off device to the cover-tape cutting device, and the sections of cover tape ribbon are transferred to the products on one of the plurality of conveying devices.

12 Claims, 1 Drawing Sheet

FILTER-ATTACHMENT MACHINE AND METHOD OF OPERATING A FILTER-ATTACHMENT MACHINE

CROSS-REFERENCE TO RELATED APPLICATION

This application claims priority to German Patent Application No. 101 60 822.5, filed Dec. 11, 2001. The disclosure of the above German priority application is incorporated herein by reference.

BACKGROUND OF THE INVENTION

The invention relates to a filter-attachment machine in, for example, the tobacco-processing industry. Such machines comprise conveying devices for products in the tobacco-processing industry and at least one drive, in particular a main drive, for the conveying devices. These machines also have a pull-off device for a cover tape and a cover tape cutting device. The cover tape is conveyed from the pull-off device to the cover tape cutting device and is cut by this cutting device into tape sections of a predetermined length. The tape sections are then transferred to a product on one of the conveying devices.

In addition, the invention relates to a method for operating a filter-attachment machine in the tobacco-processing industry.

A filter-attachment machine of this type is manufactured and sold by the assignee of the present application under the trade name MAX. For the production of filter cigarettes in a filter-attachment machine, a cover tape is pulled off a bobbin, is provided with glue on one side and is continuously cut into small cover tape sections in the cutting device. The cover tape sections are individually attached to cigarette-filter plug-cigarette groups and are wound around these groups in such a way that the groups are combined to form double-length filter cigarettes. During the subsequent processing operation, these groups are cut into individual cigarettes and are processed further. In order to cut the cover tape, a cutting drum around which the cover tape is guided and a blade drum cooperate so that the blades cut the tape crosswise to the conveying direction.

When the filter-attachment machine is stopped, small paper scraps are generated during the cutting of the cover tape in the cutting device. In case of a machine stop, the paper tape movement is switched off the moment the last tobacco rod and double-length filter have been provided with a cover tape section. To avoid the unnecessary use of cover paper, a steep ramp at the pull-off drums quickly shuts down the paper movement. At the same time, the machine discharges the last, cigarettes from the machine with a fixed empty-running speed. Since the speed of the cover paper apparatus is synchronized with the speed of the conveying drums for the filter-attachment machine, the speed difference that develops between the cover paper and the suctioning drum for the cover paper is larger because the deceleration of the pull-off drums occurs over a shorter period of time and the cutting and suctioning drums rotate at a fixed speed until the machine is empty. This speed difference results in the generating of interfering cover paper scraps while the cover paper suctioning drum continues to rotate and suction the stopped cover paper. In the process, the cover paper held in place by the suctioning drum is moved forward slightly because of the friction and is cut off. These extremely small, cut-off scraps underneath the cover paper roll represent a considerable reduction in quality. A special suctioning device was therefore developed for removing the small paper scraps.

SUMMARY OF THE INVENTION

It is an object of the invention to prevent the formation of cover paper scraps in a filter-attachment machine.

This and other objects are achieved by a filter-attachment machine in the tobacco-processing industry having a plurality of conveying devices for products in the tobacco-processing industry, and at least one main drive that drives the plurality of conveying devices. The machine also has a pull-off device for pulling a cover tape ribbon from a cover tape supply, a cover-tape cutting device for cutting the cover tape ribbon into sections of a predetermined length, and at least one secondary drive that drives the pull-off device and the cover-tape cutting device. The cover tape ribbon is conveyed from the pull-off device to the cover-tape cutting device, and the sections of cover tape ribbon are transferred to the products on one of the plurality of conveying devices.

According to further embodiments of the invention, a filter-attachment machine in the tobacco-processing industry is provided, comprising conveying devices for products in the tobacco-processing industry and at least one drive, in particular a main drive, for the conveying devices. A pull-off device is also provided for a cover tape, as well as a cover-tape cutting device. The cover tape is conveyed from the pull-off device to the cover-tape cutting device and is cut into tape sections of a predetermined length. The tape sections are then transferred to a product on one of the conveying devices. At least one drive is provided for the pull-off device and the cutting device.

According to another aspect of the invention there is provided a method for operating a filter-attachment machine in the tobacco-processing industry. The machine transports products in the tobacco-processing industry by a plurality of conveying devices that are driven by at least one main drive. The method comprises transporting a cover tape ribbon from a pull-off device to a cutting device, cutting the cover tape ribbon into tape sections of a predetermined length with the cutting device, and transferring the tape sections to the products on one of the plurality of conveying devices. The pull-off device and the cutting device are driven by at least one secondary drive.

For a uniform conveying of the cigarette products and/or the cigarettes, all drums of the filter-attachment machine are generally driven by a main drive. As a result of an independent (synchronous) drive, it is possible to operate the pull-off device and the cutting device with the same speed and independent of the rest of the filter-attachment machine. The synchronous operation of the pull-off device and the cutting device is achieved with the aid of the joint (synchronous) drive. Thus, the cover tape sections always have the same length, either at the start, during the continuous operation, or during the shutdown of the machine. The traditional problem created by the scraps is avoided because the scraps are not generated in the first place. In addition, a special suctioning device for suctioning off the scraps can be omitted, which decreases the initial cost of the machine.

According to particular embodiments of the filter-attachment machine, it is advantageous if the drive for the pull-off and cutting device can be separated from the drive for the conveying devices, in particular the main drive. By separating this drive from the main drive, a synchronized stop of the cover paper movement and the machine is possible when the machine is powered down. This is due to the pull-off device and the cutting device transporting the cover paper tape with the same conveying speed and stopping at the same time as the machine is stopped. As a result of the synchronous operation, only full-length tape sections are cut off. These precisely cut tape sections can be more properly suctioned off than the fine scraps because of their size.

It is furthermore preferable if during start-up of the machine, the drive for the pull-off and cutting device can be synchronized with the drive for the conveying devices, in particular the main drive. As a result of the position-synchronized start-up, the cover tape sections are transferred precisely to a double-length cigarette.

The drive for the pull-off and cutting device is advantageously designed as a synchronous drive. The term "synchronous drive" is also understood to include individual drives (for the pull-off and cutting device), which are synchronized, so that a synchronous operation of the pull-off and cutting device is achieved.

According to one advantageous embodiment, the pull-off device is designed as a pair of pull-off drums through which the cover tape is guided. The driven drums pull the cover tape off a bobbin.

It is furthermore preferable if the cutting device is designed to comprise a cutting drum and a blade drum.

Further aspects of the invention include methods for operating a filter-attachment machine in the tobacco-processing industry in which products in the tobacco-producing industry are transported with conveying devices driven by at least one drive, in particular a main drive. A cover tape is transported by a pull-off device to a cutting device and is cut by the cutting device into tape sections of a predetermined length which are then transferred to a product on one of the conveying devices. In preferred embodiments, the pull-off device and the cutting device are operated with the aid of at least one drive.

When the machine is stopped, the drive for the pull-off and cutting device is advantageously separated from the drive for the conveying devices.

It is furthermore advantageous if during the startup of the machine, the drive for the pull-off and cutting device is operated synchronously with the drive for the conveying devices.

In addition, the drive is preferably designed as a synchronous drive.

According to one embodiment of the method, it is advantageous if the cover tape is pulled off with the aid of a pair of pull-off drums. According to another embodiment of the invention, the cover tape is furthermore cut with a cutting drum and a blade drum.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
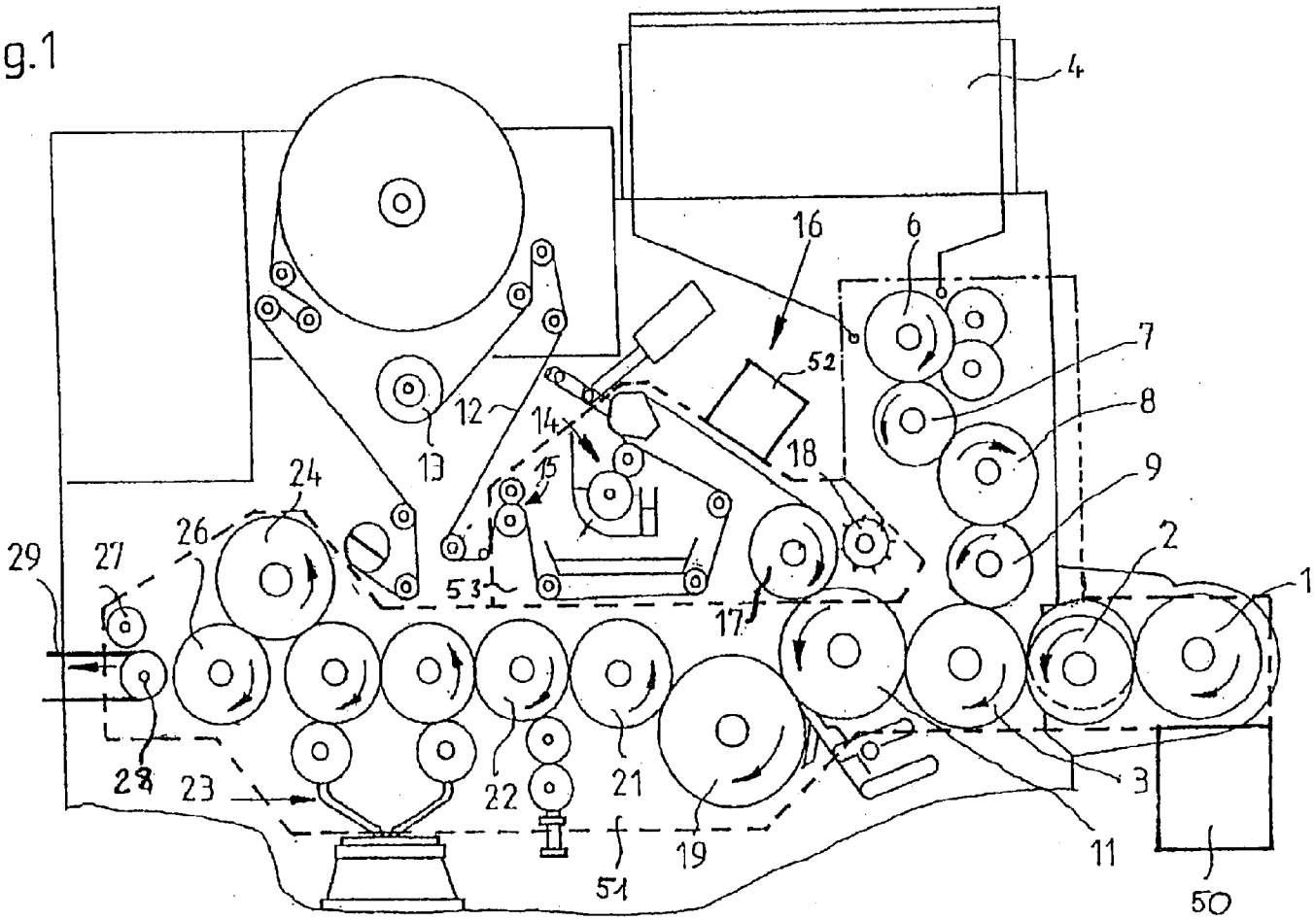
FIG. 1 is a schematic view of a filter attachment machine in accordance with the invention.

The invention is explained in the following with the aid of an exemplary embodiment shown in FIG. 1.

FIG. 1 shows a schematic view of the front of a MAX filter-attachment machine manufactured and sold by the assignee of the present application. With this filter-attachment machine, an intake drum 1 transfers staggered cigarettes produced in a cigarette-production machine to two staggering drums 2. The staggering drums 2, de-stagger the cigarettes supplied by the intake drum 1 and then transfers these, in rows containing respectively two items with an intermediate space between the cigarettes, to an assembly drum 3. Filter rods are moved from a magazine 4 to a cutting drum 6. On the cutting drum 6, the filter rods are cut into double-length filter plugs, are arranged staggered on a staggering drum 7, are aligned by a pushing drum 8 to form a row of successively arranged plugs and are deposited with an accelerating drum 9 into the intermediate spaces between the cigarette rows on the assembly drum 3.

The cigarette-filter-cigarette groups are pushed together and are taken over by a transfer drum 11.

A cover tape 12 that is pulled with a pair of pull-off drums 15 from a cover paper bobbin 13 is subsequently coated with glue. The glue is applied with a glue-spreader 14 and the tape is then cut in a cutting device 16 into tape sections. Cutting device 16 has a cutting drum 17 and a blade drum 18. The cut-off cover tape sections are then attached to the cigarette-filter-cigarette groups on the transfer drum 11 and are rolled around these groups with the aid of a rolling drum 19. The finished double-length filter cigarettes are supplied via a drying drum 21 to a cutting drum 22, where they are turned into individual filter cigarettes by cutting through the center of the filter plug.

A turning device 23 turns a cigarette row and simultaneously transfers it to the row of unturned filter cigarettes passing through. The filter cigarettes travel via a test drum 24 to a cigarette rejection drum 26. A delivery drum 28, which cooperates with a brake drum 27, deposits the filter cigarettes on a delivery belt 29.

The glue spreader 14 comprises a pull-off drum (not described in further detail herein) that is at lease partially submerged into a glue supply and a glue-application drum, which spreads a layer of glue onto the cover paper tape 12. By way of a deflection and oscillating arrangement, the cover paper tape 12 is guided toward the cutting drum 17, which it encircles with a predetermined angular section opposite the blade drum 18. Suction air is supplied in the standard way to the circumferential surface of the cutting drum 17 via suction air bores. The suction air, which holds the cover paper tape 12 against the surface of cutting drum 17, is metered out such that a slippage is possible between the cover tape 12 and the surface of the cutting drum 17. The cutting drum 17 is provided with grooves in its circumferential surface that run parallel to the axis of the drum. The front flank of each groove in the moving direction is designed as a cutting edge for cutting the cover tape section from the cover paper tape 12.

The blade drum 18, which belongs to the cutting device 16, is provided along its circumference with blades mounted transverse to the circumferential direction. During the rotation, these blades successively dip into the grooves of the cutting drum 17.

Drums are provided for moving the cigarettes and filters inside the filter-attachment machine. With the aid of a gear unit 51, a main drive 50 can operate the intake drum 1, the staggering drum 2, the assembly drum 3, the cutting drum 6, the staggering drum 7, the stacking drum 8, the acceleration drum 9, the transfer drum 11, the rolling drum 19, the drying drum 21, the cutting drum 22, the turning device 23, the test drum 24, the rejection drum 26, the brake drum 27 and the delivery drum 28.

A separate drive 52 is provided for the pull-off drum pair 15 and the cutting device 16. Together with an associated gear unit 53, this drive synchronously drives the pull-off device 15 and the cutting device 16 and possibly also additional conveying drums for the cover tape 12. The synchronous drive 52 according to the invention ensures a synchronous movement of the devices 15, 16 and helps ensure that equally long cover tape sections are cut off, even during a machine shutdown. During a power-down of the machine, the synchronous drive 52 is separated from the main drive 50. The startup of the machine is position-synchronous between the main drive 50 and the synchronous drive 52.

Since the cutting device 16 always cuts off cover tape sections having the same length, owing to the separate synchronous drive 52, no paper scraps are generated when the machine is powered down. Since the dimensions of the tape sections are maintained during the shutdown of the machine, the tape sections that are still being cut can be removed safely with a suctioning device.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A filter-attachment machine in the tobacco-processing industry, comprising:

a plurality of conveying devices for products in the tobacco-processing industry;

at least one main drive that drives the plurality of conveying devices;

a pull-off device for pulling a cover tape ribbon from a cover tape supply;

a cover-tape cutting device for cutting the cover tape ribbon into sections of a predetermined length;

at least one secondary drive that drives the pull-off device and the cover-tape cutting device; and means for separately driving the secondary drive when the machine is stopped, wherein the cover tape ribbon is conveyed from the pull-off device to the cover-tape cutting device, and the sections of cover tape ribbon are transferred to the products on one of the plurality of conveying devices.

2. The filter-attachment machine according to claim 1, wherein, during a startup of the machine, the secondary drive is synchronizable with the main drive.

3. The filter-attachment machine according to claim 1, wherein the secondary drive synchronizes speeds of the pull-off device and the cover-tape cutting device.

4. The filter-attachment machine according to claim 1, wherein the pull-off device comprises a pair of pull-off drums.

5. The filter-attachment machine according to claim 1, wherein the cover-tape cutting device comprises a cutting drum and a blade drum.

6. The filter-attachment machine according to claim 1, wherein the cover-tape device cuts the tape sections in the predetermined length during at least a portion of time when the machine is stopping.

7. A method for operating a filter-attachment machine in the tobacco-processing industry, the machine transporting products in the tobacco-processing industry by a plurality of conveying devices that are driven by at least one main drive, the method comprising:

transporting a cover tape ribbon from a pull-off device to a cutting device;

cutting the cover tape ribbon into tape sections of a predetermined length with the cutting device; and transferring the tape sections to the products on one of the plurality of conveying devices, wherein the pull-off device and the cutting device are driven by at least one secondary drive, and wherein during a stoppage of the machine, the secondary drive is driven separately from the main drive.

8. The method according to claim 7, wherein during a startup of the machine, the secondary drive is synchronized with the main drive.

9. The method according to claim 7, wherein the secondary drive synchronizes speeds of the pull-off device and the cutting device.

10. The method according to claim 7, wherein the pull-off device comprises a pair of pull-off drums.

11. The method according to claim 7, wherein the cutting device comprises a cutting drum and a blade drum.

12. The method of claim 7, wherein the tape sections are cut in the predetermined length during at least a portion of the machine stoppage.

* * * * *